United States Patent [19]

Denison

[11] Patent Number: 4,545,437

[45] Date of Patent: Oct. 8, 1985

[54] DRILLING RISER LOCKING APPARATUS AND METHOD

[75] Inventor: Early B. Denison, Houston, Tex.

[73] Assignee: Shell Offshore Inc., Houston, Tex.

[21] Appl. No.: 597,994

[22] Filed: Apr. 9, 1984

[51] Int. Cl.[4] ..... E21B 19/09

[52] U.S. Cl. ..... 166/345; 166/353; 166/355; 166/362

[58] Field of Search ..... 166/344, 345, 352–355, 166/362, 367

[56] References Cited

U.S. PATENT DOCUMENTS 3,717,002 2/1973 O'Brien et al. ..... 166/345

4,428,433 1/1984 Watkins ..... 166/345

*Primary Examiner*—Stephen J. Novosad

*Assistant Examiner*—William P. Neuder

[57] ABSTRACT

Apparatus and method for use in drilling a well from a floating vessel by means of a riser, which connects the vessels drilling equipment to a wellhead assembly adjacent the ocean floor. The riser is capable of being disconnected from the wellhead assembly, and having its upper elements locked to the vessel. This allows the riser to be suspended from the floating vessel, or permits maintenance of the normal riser motion-compensating and tensioning equipment. Riser locking apparatus is employed which comprises selectively positionable moveable locking beams adapted to be remotely actuated to lock the upper elements of the riser to the vessel, thereby preventing lateral or vertical movement of the riser relative to the vessel after the lower end thereof has been disconnected from the wellhead assembly.

22 Claims, 13 Drawing Figures

34
24
33
59
60
62
12
62A
60A
59A
100
58
11
58A
110A
10
27
110B
50
20
20A
50A
25
25A
26
30
80
31
31A
80A
30A
90
13
32
14
23
V
16
22
15

V
V
16A
15A
V
13
21
17
19
18
28

90
30A
30
7
27
61
50A
59A
58B
50B
60C
20A
31A
6
10
60D
58A
59B
80B
80A
80C
80
58C
58
50C
60B
20
31
60E
59
59C
50
61A
110A
110B
TO CONTROL PANEL
140
130
120
100

DRILLING RISER LOCKING APPARATUS AND METHOD

BACKGROUND OF THE INVENTION

1. Field of the Invention

The present invention is directed to apparatus and method for drilling a well into earth formations lying below a body of water, wherein the wellhead equipment of the well is positioned below the surface of the water. The well is drilled from a floating drilling vessel, with a riser conduit connecting the vessel drilling equipment to the wellhead assembly.

2. Description of the Prior Art

An increasing amount of offshore deepwater exploratory well drilling is being conducted in an attempt to locate oil and gas reservoirs. These exploratory wells are generally drilled from floating vessels. As in any drilling operation, drilling fluid must be circulated through the drill bit in order to cool the bit and to carry away the cuttings. This drilling fluid is normally returned to the floating vessel by means of a large diameter pipe, known as a riser, which extends between the subsea wellhead assembly and the floating vessel. The lower end of this riser is connected to the wellhead assembly which is generally adjacent to the ocean floor, and the upper end usually extends through a centrally located hull opening of the floating vessel. A drillstring extends downward through the riser into earth formations lying below the body of water, and drilling fluids circulate downwardly through the drillstring, out through the drilling bit, and then upwardly through the annular space between the drillstring and riser, returning to the vessel.

As the water depths for these drilling operations continue to increase, the length of the riser and subsequently its unsupported weight also increases. Since the riser has the same structural buckling characteristics as a vertical column, riser structural failure may result if compressive stresses in the elements of the riser exceed the metallugical limitations of the riser material. Two separate mechanisms are typically used to avoid the possibility of this cause of riser failure.

Riser tensioning systems are installed on board the vessel, which apply an upward force to the upper end of the riser, usually by means of cable and sheave mechanisms connected between the vessel and the upper elements of the riser.

Buoyancy or ballasting means may also be attached to the submerged portion of the riser. These usually are comprised of syntactic foam or individual ballast tanks formed on the outer elements of the riser section. The ballast tanks are capable of being selectively inflated with air from the floating vessels air compression equipment. Both of these buoyancy devices create upwardly directed forces in the riser, compensating for the compressive stresses created by the risers weight, and thereby preventing riser failure.

Since the riser is fixedly secured at its lower end to the wellhead assembly, the floating vessel will move relative to the upper end of the riser due to wind, wave, and tide oscillations normally encountered in the marine environment.

This creates a problem because the stationary riser located within the hull opening of the oscillating vessel can contact and damage the vessel, unless it remains safely positioned within the hull opening. For this reason motion-compensating equipment incorporated with the riser tensioning system is used to steady the riser within the hull opening, and usually takes the form of hydraulically actuated cable and sheave mechanisms connectably engaged between the upper riser elements and the vessel structure, and a flexible coupling located in the riser adjacent the vessel's hull. This equipment allows the vessel to heave, surge, and sway, without contacting the upper elements of the riser.

Directional positioning thrusters, in addition to the normal maneuvering system of the vessel, compensate for normal current and wind loading, and prevent riser separation due to the vessel being pushed away from the wellhead location.

All of these systems, however, can only prevent riser compressive failure, separation, or contact with the vessel during normal sea state conditions.

The capacity of these systems is exceeded with winds typically over 35 to 40 mph and/or swells over a height of 25 feet. Above these values, further measures need to be taken to prevent riser and vessel damage.

The riser may be disassembled in sections and stowed on the floating vessel's deck, but the time required for this operation usually exceeds the warning time given by an oncoming storm system.

The riser may be disconnected from the wellhead assembly and thereby become suspended from the vessel. The vessel with the suspended riser then may remain in the vicinity of the wellhead assembly, or the vessel may attempt to tow the riser out of the path of the approaching storm. In either situation, once the riser's lower element disconnected from the wellhead assembly, the riser becomes a vertically orientated submerged vessel with its own oscillatory characteristics, or "bobbing" tendencies, typically different than those of the supporting vessel. When the vessel and riser heave upward, due to the vessel riding the crest of the wave, the riser may continue upwards while the vessel is falling downwards in a subsequent wave trough. This uncontrolled upward riser movement and subsequent downward movement through the center of the hull opening can exceed the allowable vertical movement and load capacity of the normal motion compensating and tensioning equipment, causing severe damage to the vessel and riser, with attendant risk to crew and vessel. Further means need to be developed to prevent the riser from this uncontrolled upward and downward motion within the vessel's hull opening.

SUMMARY OF THE INVENTION

The present invention is directed to locking the upper end of the drilling riser to the vessel. This eliminates downward, upward, and lateral movement of the riser relative to the vessel, obviating the above problem.

The invention is comprised of riser locking apparatus carried within the hull opening of the floating vessel, adjacent the bottom of the vessel. The riser locking apparatus is carried at this lower elevation so that the angular displacement of the riser at its upper flexible coupling will not cause the riser, in its displaced position, to contact and damage the vessel's hull. The riser locking apparatus comprises a pair of movable beams that can be moved towards each other, at the closest point of travel engaging the upper elements of the riser. Locking these beams in their closed position effectively locks the riser's upper end to the vessel. Riser positioning means are also provided to properly position the riser between the moveable locking beams prior to closure of these beams.

This invention may be used to safely transport the riser away from the current drilling location in order to avoid a marine storm environment, it may be used to transport the riser from one wellhead assembly to another prior to performing normal drilling operations, it may be used during maintenance operations on the vessel's motion-compensating and riser tensioning equipment, or it may be used to suspend the riser for an indeterminate length of time beneath the vessel.

Accordingly, it is an object of the invention to provide an offshore vessel with riser locking apparatus to securely lock the upper end of the riser to the vessel, thereby preventing relative motion between the upper end of a suspended riser and the vessel. This riser locking means includes movable locking beams, supporting tracks for these beams, and related beam locking methods.

Another object is to provide the same offshore vessel with means to transport this riser from one location to another in a safe manner during normal or inclement weather conditions, or to allow the maintenance and repair of the normal riser support mechanisms.

A further object of the invention is to provide a riser locking apparatus which is simple in design, rugged in construction, and economical to manufacture.

The various features of novelty which characterize the invention are pointed out with particularity in the claims next to and forming a part of this disclosure. For a better understanding of the invention, its operating advantages and specific object obtained by its uses, reference should be made to the accompanying drawing and descriptive matter in which there are illustrated preferred embodiments of the invention.

DESCRIPTION OF THE PREFERRED EMBODIMENT

Figure 1:
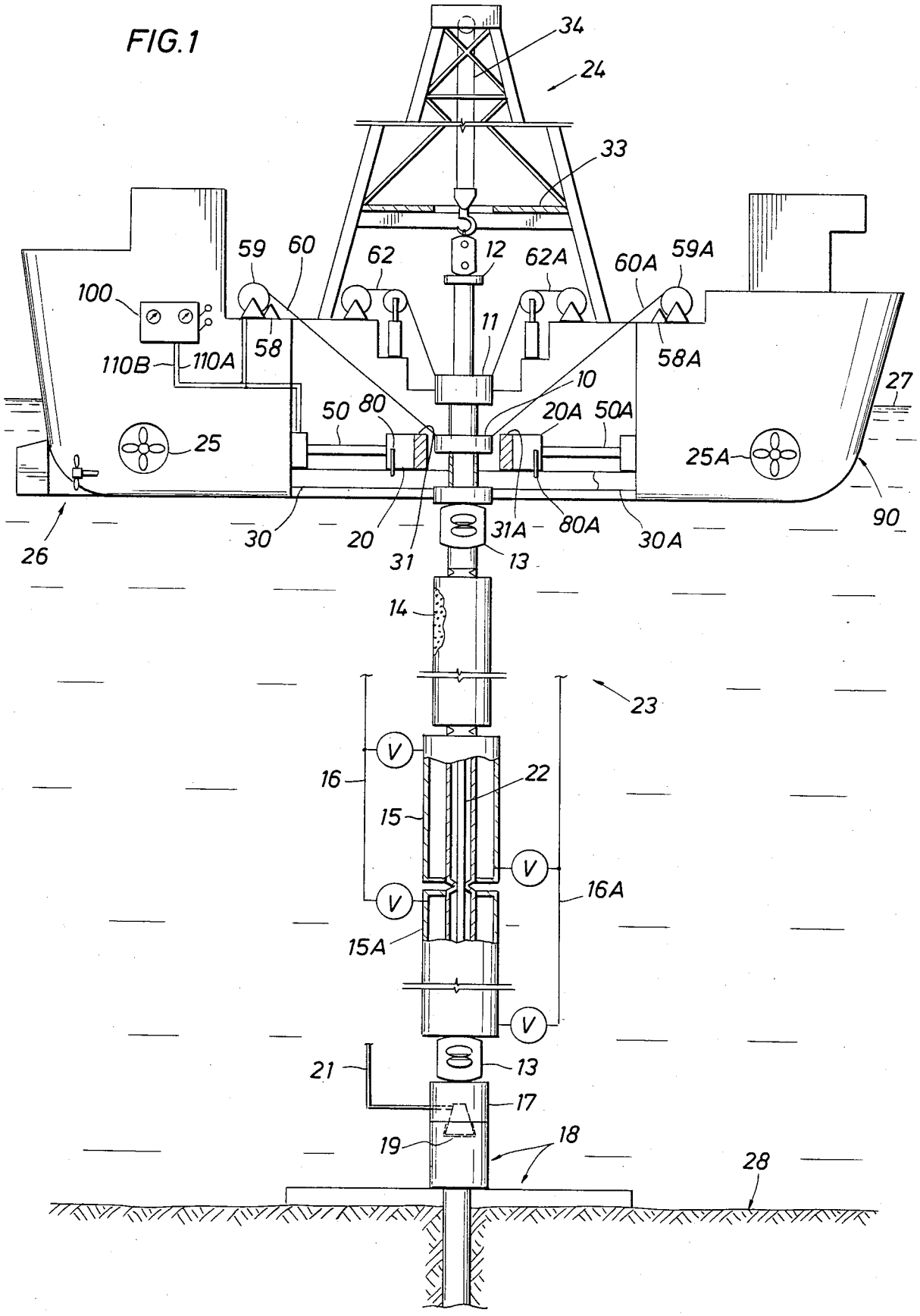
FIG. 1 is a schematic representation of an underwater drilling operation in which a riser, according to the present invention, is shown connected between a floating vessel and a subsea wellhead assembly.

FIG. 1 shows an offshore drilling vessel 90 floating in a body of water 27 above the ocean floor 28 with a riser 23 connected between the ocean floor 28 and the riser motion compensating and tensioning means 62, 62A of the vessel 90. The motion compensation and tensioning apparatus 62, 62A, which is well known to the art, allows the riser to move vertically in a controlled manner within the centrally positioned hull opening of the vessel 90 and also applies an upward force to the riser elements in order to prevent buckling of the riser. Personnel positioned on the derrick room floor 33 conduct drilling operations through the riser down to the subsea formation located beneath the ocean floor 28, utilizing the drill string and riser lifting mechanism 34. The motion of the vessel 90 relative to the riser's upper elements is compensated by means of a riser inner barrel 12 which telescopically moves within the riser outer barrel 11. This movement allows the drilling operations from the derrick room floor 33 to proceed at a varying elevation from the ocean floor 28. The riser inner barrel 12 may be fully extended by upward movement of the drill string and riser lifting mechanism 34. In this fully extended position lifting forces may be applied to the upper end of the riser 23, in order to raise the riser 23 within the vessel 90.

Positioned below the riser outer barrel 11 is the riser stop means 10. When the riser stop means 10 is securely locked to moveable locking beams 20, 20A, the riser 23 upper elements are prevented from moving relative to the vessel 90. This allows the riser 23 to be suspended from the vessel 90 and subsequently safely transported from one location to another, such as to avoid a storm at the original location or to commence drilling operations at another location. The riser 23 may also be secured beneath the floating vessel 90 from the riser stop means 10, for an indeterminate length of time, or during maintenance operations on the riser motion compensating and tensioning means 62, 62A.

Positioned below the riser stop means 10 is a flexible coupling 13 which allows the riser 23 to bend below the bottom of the floating vessel 90 during the vessel's movement above the wellhead assembly 18, and during riser 23 towing operations.

Figure 4:
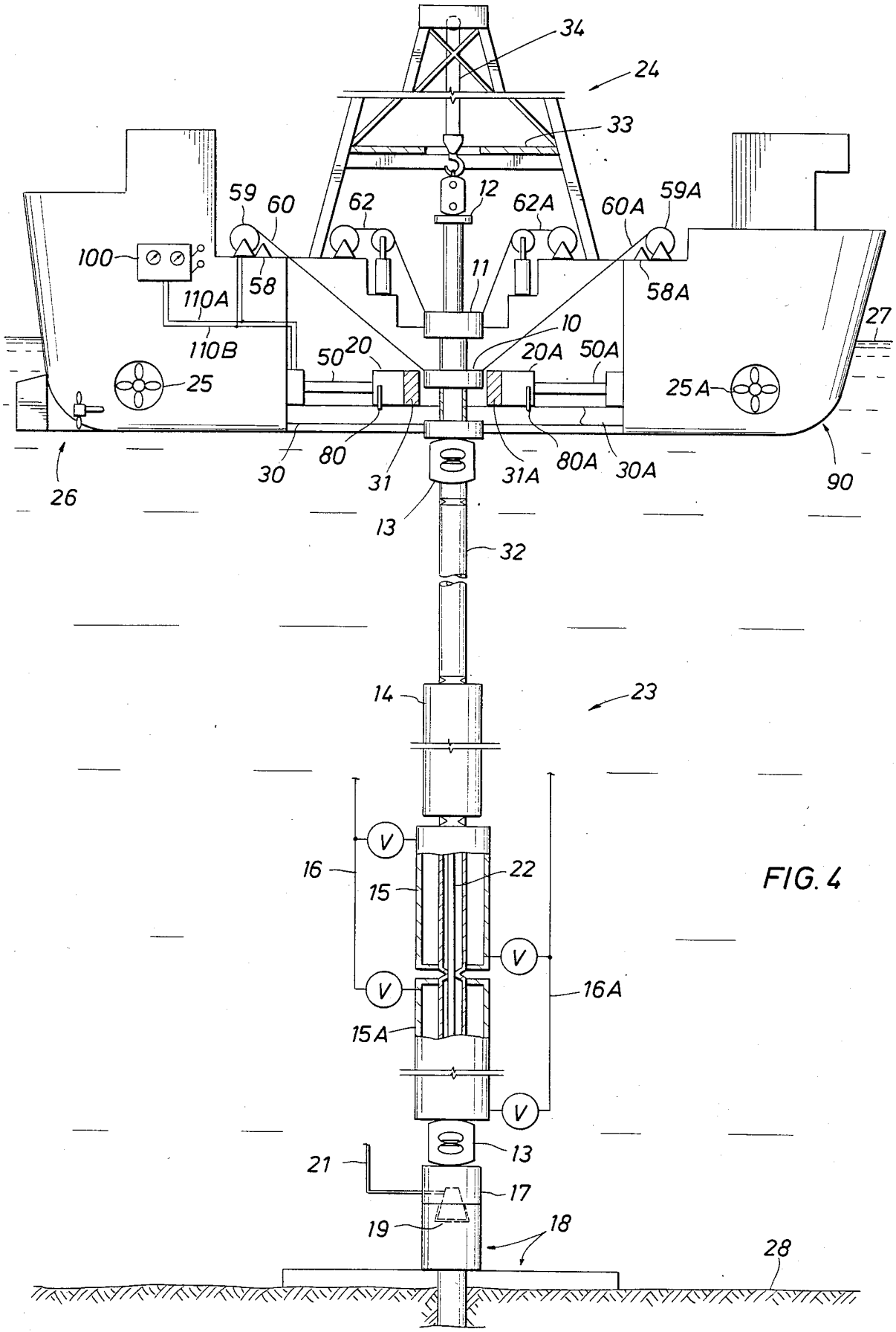
FIG. 4 is a schematic representation of an underwater drilling operation in which a riser, according to the present invention, is shown connected to a new wellhead assembly with additional riser sections added to compensate for the increase in water depth.

Below the flexible coupling 13 is a series of riser 23 sections comprising buoyancy chambers 15, 15A, syntactic foam floats 14 attached to the outer elements of the riser 23, or plain sections with no float mechanisms, 32, (shown in FIG. 4). The buoyancy chambers 15, 15A are capable of having buoyancy adjusting means 29, 29A (FIG. 2) added or removed from them. Increasing the buoyancy of the riser 23 averts compressive failure of the riser 23 when connected to the wellhead assembly 18, while decreasing the buoyancy reduces the upward vertical forces or "bobbing" tendencies of the riser 23 on the riser locking apparatus while the riser 23 is locked in position beneath the vessel. Buoyancy adjusting control means 16, 16A, operated from the offshore vessel 90 are capable of controlling the buoyancy that is added or removed from the buoyancy chambers 15, 15A. A drill string 22 can also be placed within the riser section 23 for additional ballast though normally it is removed. This drill string 22 is shown in FIG. 1 in a partial cutaway view of the buoyancy chamber 15. The length of the riser 23 may also be altered by the addition or removal of riser 23 sections 14, 15, 15A, and 32 (FIG. 4.).

Another flexible coupling 13 is located below the ballasting means of the riser 23 and just above a drilling wellhead assembly, 18, which allows the upper portions of the riser 23 to bend relative to the wellhead assembly 18 due to vessel 90 surface movement caused by wind, wave and tide conditions. Typically located below the flexible coupling 13 is the lower end of the riser 23 which incorporates a wellhead connection means 19 of any construction well known to the art which is activated through the wellhead control means 21 in order to disconnect or connect the riser 23 from the subsea wellhead assembly 18.

Directional positioning thrusters 25, 25A are typically incorporated below the water line of the floating vessel 90 in order to compensate for normal wind, wave and tide forces imposed upon the floating vessel 90. Vessel motive or propulsion means 26 are used for normal movement of the floating vessel 90 from one location to another.

The riser locking apparatus is comprised of track means 30, 30A which are typically slidably engaged with the moveable locking beams 20, 20A. The moveable locking beams 20, 20A slide across the track means 30, 30A by actuation of the moveable locking beams prime mover means 50, 50A in the form of piston and cylinders. Removeable locking means 80, 80A in the form of pins are used to lock the moveable locking beams 20, 20A to the track means 30, 30A at a selected position thereon. Landing areas 31, 31A located on the moveable locking beams 20, 20A are formed to engage and lock with the riser stop means 10 when the moveable locking beams 20, 20A are moved to their closest position to the riser stop means 10, i.e., substantially in contact therewith.

The riser locking apparatus is preferably controlled by a control panel 100 coupled to a power source and to the various elements of the apparatus. This control panel 100 synchronizes the operation of the beam engagement and locking mechanisms so as to effectively lock or unlock the upper end of the rier 23 section from the floating vessel 90. Hydraulic control lines 110A, 110B may be used to supply motive power to the various prime mover means 50, 50A, 59, 59A employed by the riser locking apparatus. In the preferred embodiment piston and cylinder mechanisms are utilized to move the moveable locking beams 20, 20A and hydraulic winches are used to actuate the riser positioning means 60, 60A. It is recognized that other prime mover or motive means well known to the art may be used, such as a cable and sheave system.

Figure 5:
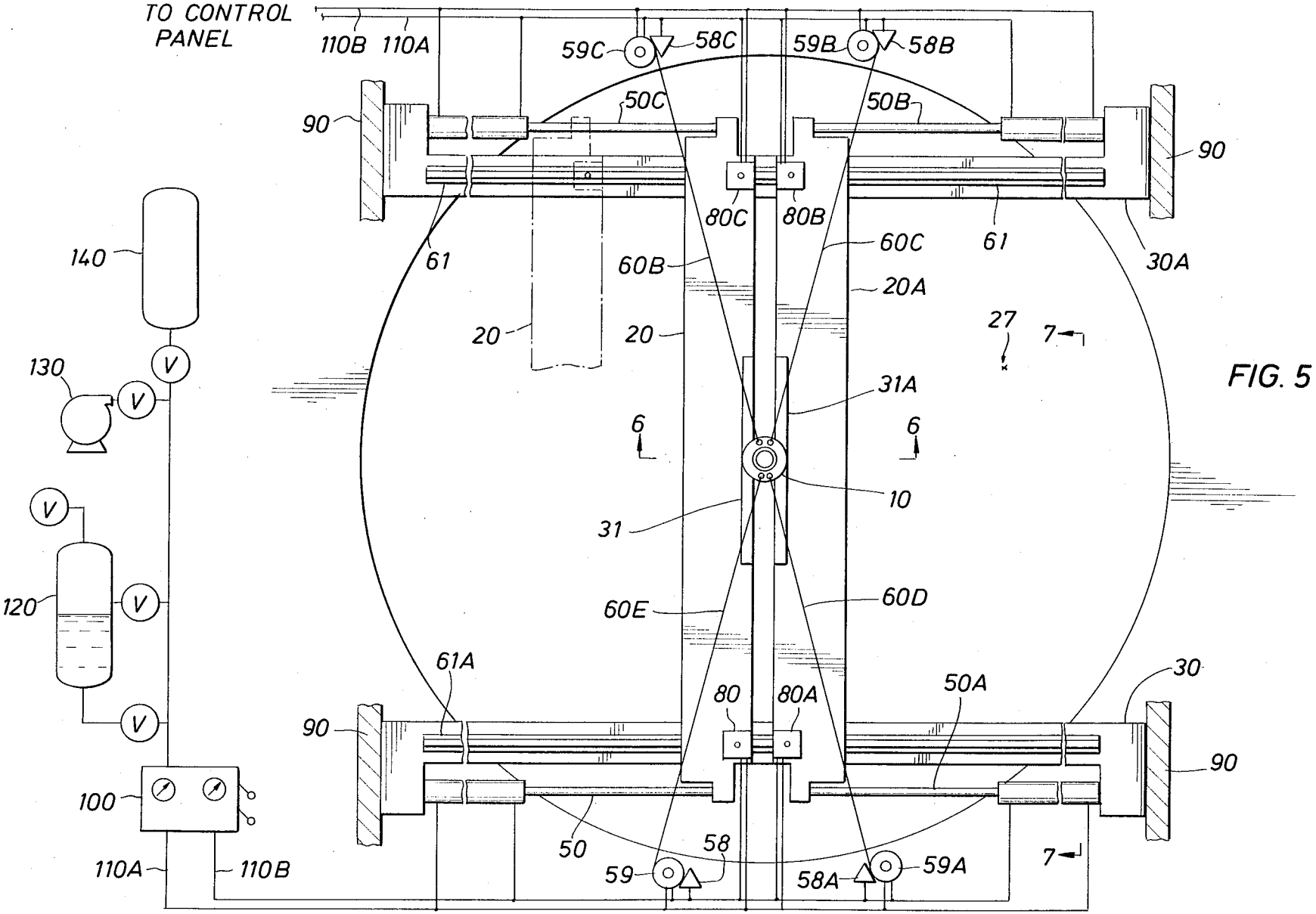
FIG. 5 is a plan view of the riser locking apparatus shown in place in the centrally located hull opening of the floating vessel.

In order to properly locate the riser stop means 10 within the moveable locking beams 20, 20A, riser positioning means 60, 60A and the drill string and riser lifting mechanism 34 are used to apply vertical and lateral positioning forces to the upper elements of the riser 23. Riser tensioning and motion compensating means 62, 62A may also be used to apply vertical and lateral positioning forces to the riser 23. Once the riser 23 is in proper position relative to the moveable locking beams 20, 20A the riser positioning means locking means 58, 58A locks the riser positioning means prime mover means 59, 59A in a stationary position, thereby locking the riser positioning means 60, 60A in their proper location. Riser positioning means 60, 60A may be comprised of a cable and sheave mechanism as shown in FIG. 5, elements 60B, 60C, 60D and 60E being the cables and 59, 59A, 59B, and 59C being the power winches connected thereto. It is recognized that other mechanisms may accomplish the same result, such as the apparatus schematically represented in FIG. 8.

Figure 2:
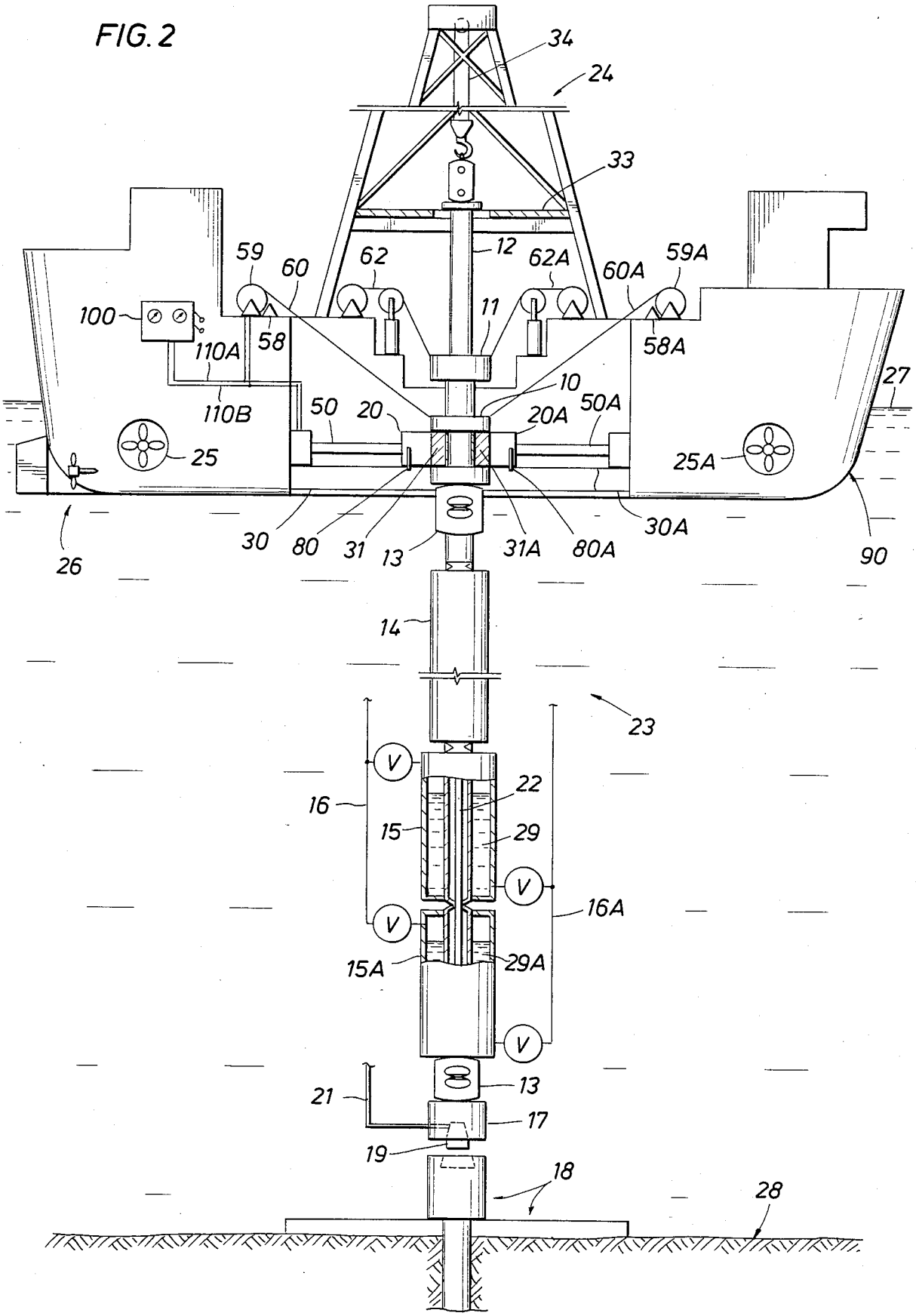
FIG. 2 is a schematic representation of an underwater drilling operation in which a riser assembly, in accordance with the present invention, is shown disconnected from the lower subsea wellhead assembly and locked in position at its upper end by the floating vessel's riser locking apparatus.

FIG. 2 shows the floating vessel 90 and riser 23 in a position to be moved from the original wellhead assembly 18 location. As can be seen, the riser locking apparatus has fixedly engaged the riser stop means 10, the riser 23 in this case having been previously disconnected from the wellhead assembly 18 by operation of the wellhead connection means 19 at the bottom of the riser 23. Ballast 29, 29A may be added to the buoyancy chambers 15 15A as by flooding, in order to suppress the vertical movement or "bobbing" tendency of the riser 23 within the hull opening of the floating vessel 90. The riser tensioning and motion compensating means 62, 62A and the drill string and riser lifting mechanism 34 may be used to raise the riser 23 within the central hull opening of the vessel 90 in order to engage the landing areas 31, 31A of the moveable locking beams 20, 20A with the cooperating landing areas formed on or incorporated into the riser stop means 10. The riser inner barrel 12 at this time is fully extended outward from the riser outer barrel 11, allowing lifting forces to be applied to the riser 23 from the upward movement of the drill string and riser lifting mechanism 34. The drill string 22 may be removed from the riser 23 prior to moving the vessel 90 from location or it may be left in position within the riser 23 in order to add to the negative buoyancy of the riser assembly, if desired.

Figure 3:
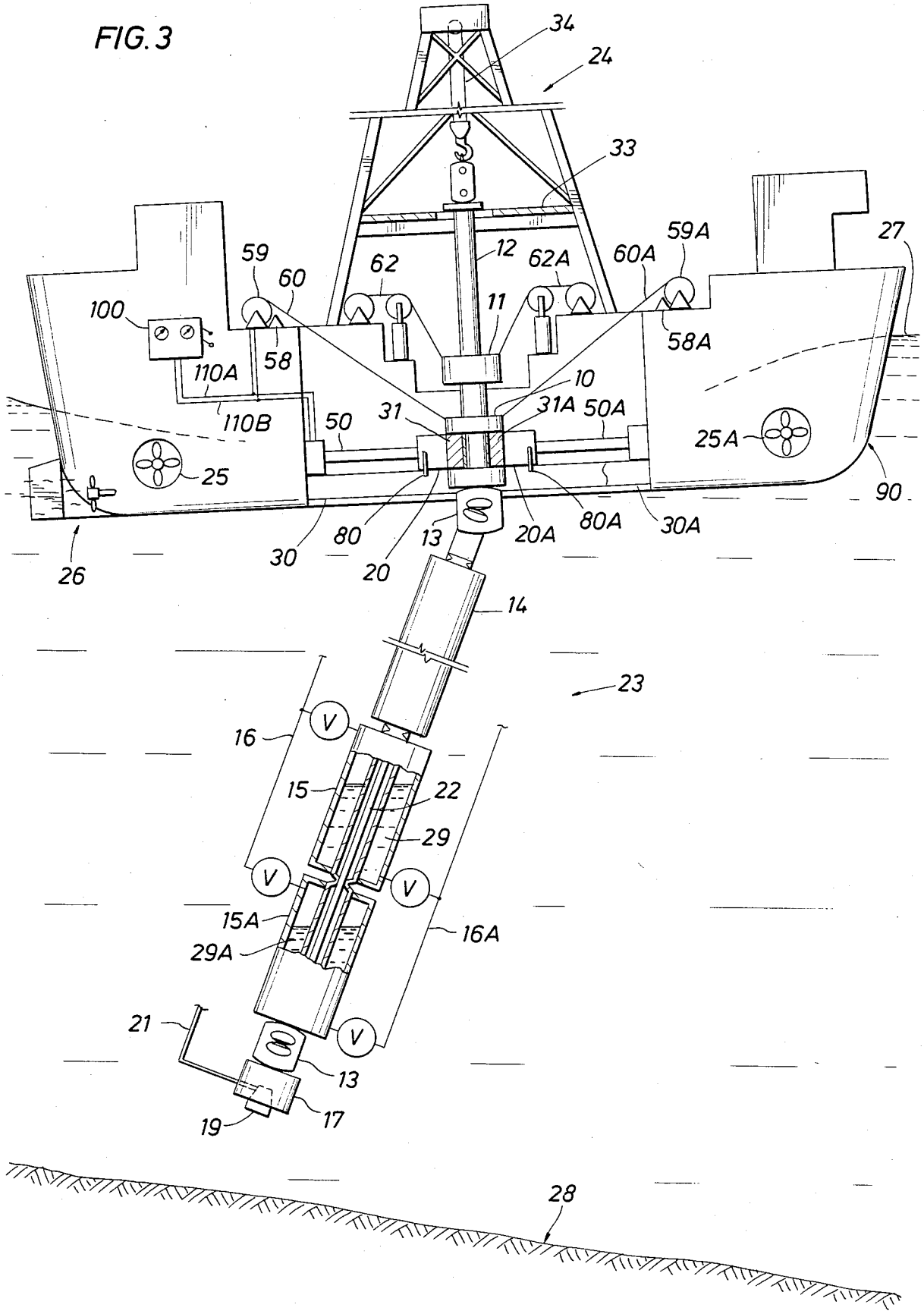
FIG. 3 is a schematic representation of riser towing operation in which a riser assembly, in accordance with the present invention, is shown being towed from the original drilling location to another location with the upper end of the riser being locked to the vessel by means of the riser locking apparatus.

As shown in FIG. 3, the vessel is now underway using vessel motive or propulsion means 26 in order to move the vessel 90 and the riser 23 away from a storm condition or in order to transport the riser 23 to a new wellhead assembly 18 location. The riser assembly 23 can bend at the flexible coupling 13 located beneath the riser stop means 10. The upper end of the riser 23 is prevented from movement relative to the vessel 90 by the engagement of the riser stop means 10 with the landing areas 31, 31A incorporated into the moveable locking beams 20, 20A. At this time the moveable locking beams 20, 20A are securely affixed to the track means 30, 30A, by use of movable locking beam locking means 80, 80A in the form of pins which are operable from a control panel 100. Forces generated by the hydrodynamic imbalances existing between the vessel 90 and the riser 23 may be absorbed entirely by the riser locking apparatus, or a small additional upward force may still be applied by the drill string and riser lifting mechanism 34 or by the riser tensioning and motion compensating means 62, 62A to the upper elements of the riser 23, if storm conditions have not rendered these means inoperative.

As shown in FIG. 4, the vessel 90 has arrived at either a new location or has returned to the original location. The moveable locking beams 20, 20A have been disengaged from the riser stop means 10, and the riser motion compensating and tensioning means 62, 62A now maintain an upward force on the riser 23. The rier inner barrel 12 has returned to its normal telescoping position within the riser outer barrel 11. The riser 23 has been reconnected to the wellhead assembly 18, and drilling operations have been resumed. Additional riser sections 32 may have been added or removed from the riser 23 in order to adjust the height of the riser 23 relative to the derrick room floor 33. Depending on the buoyancy required for the riser 23, these additional riser sections 32 may be syntatic foam float 14, buoyancy chamber 15, 15A or a riser section that does not incorporate any of these buoyancy means. A combination of these sections may be used.

As shown in more detail in FIG. 5 the moveable locking beams 20, 20A, are slidably engaged with track means 30, 30A positioned on opposite sides of the centrally located hull opening within the floating vessel 90. The riser stop means 10 are centrally positioned between the landing areas 31, 31A by means of the riser positioning means 60, 60A, which in this embodiment is made up of cables 60B, 60C, 60D, 60E. Lateral movement limiting means 61, 61A which may be in the form of tracks prevent the moveable locking beams 20, 20A from moving perpendicular to the longitudinal axis of the track means 30, 30A. The moveable locking beams 20, 20A can be locked in either the stowed position, or the riser 23 locking position, by the use of moveable locking-beam locking means or pins 80, 80A, 80B, 80C. A hydraulic accumulator 120, pump 130, and reservoir 140 may be included as part of the control system in order to supply hydraulic fluid under pressure for operation of the various prime mover means. It is recognized that, whereas these components are shown linked to the same hydraulic line prior to their connection with a control panel 100, each component may also be independently connected to a control panel 100. Hydraulic control lines 110A, 110B, may also be connected to their respective components in any manner, known to the art, though they are shown connected in a parallel manner to the components shown in FIG. 5 and FIG. 7.

Figure 6:
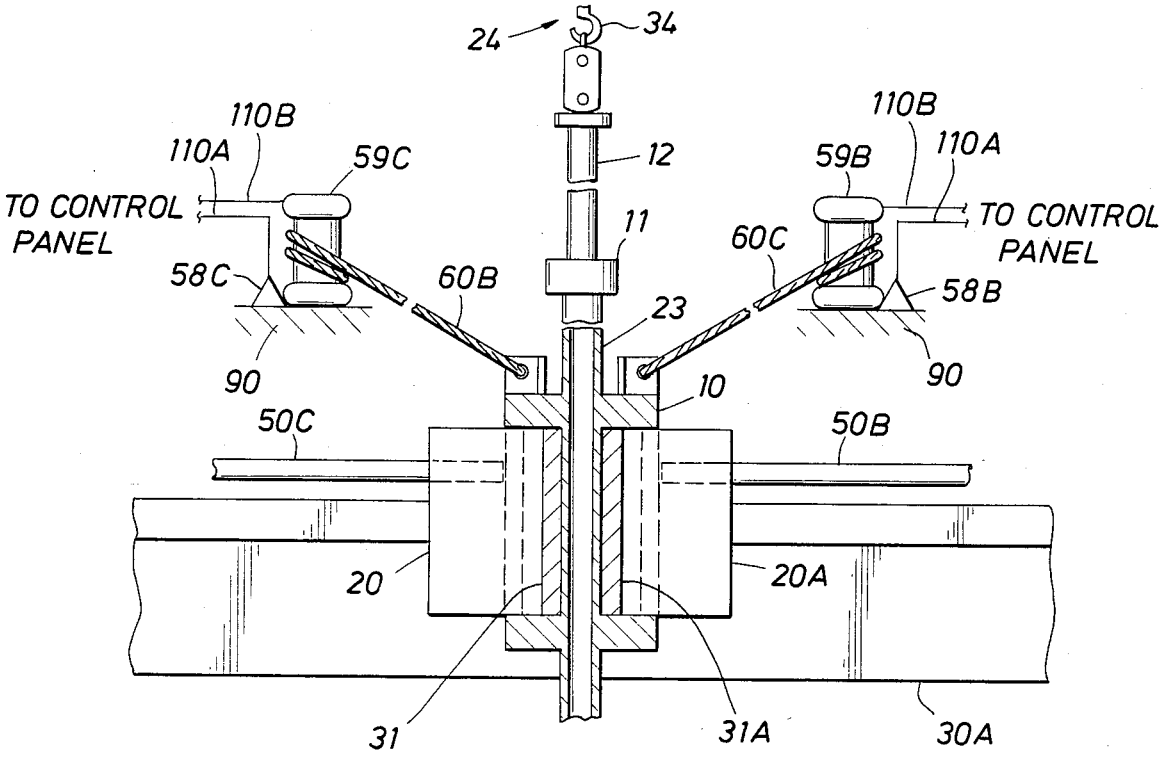
FIG. 6 is a schematic partial view in cross section taken along lines 6—6 of FIG. 5 further illustrating the riser top means and riser positioning systems.

FIG. 6 shows the riser stop means 10 positioned within the moveable locking beams 20, 20A when they are in close spaced relationship to one another. As can be seen, the moveable locking beams 20, 20A landing areas 31, 31A now contact corresponding surfaces of the riser stop means 10.

The riser stop means 10 has been positioned at the correct lateral displacement along the length of the moveable locking beams 20, 20A by operation of the riser positioning means cables 60B, 60C, 60D, 60E by winches 50, 59A, 59B, 59C driven by suitable prime mover means built into the winches. When the riser positioning cable are not being used, they are locked in position by locking means 58, 58A, 58B, 58C located on the winches.

In operation, the riser stop means 10 is placed at the proper vertical elevation relative to the landing areas 31, 31A, by operation of the riser motion compensating and tensioning means 62, 62A, and the drill string and riser lifting mechanism 34 which provides an upward lift on the riser 23 when the riser inner barrel 12 has been fully extended within the riser outer barrel 11 (FIG. 1).

Figure 7:
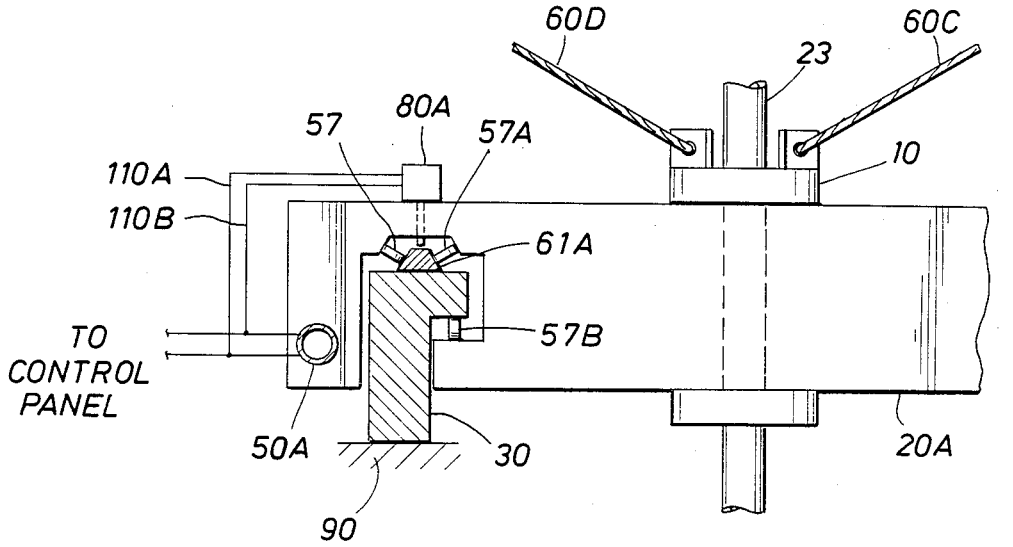
FIG. 7 is a schematic partial view in cross section taken along lines 7—7 of FIG. 5 further illustrating the movable locking beams and the track means.

FIG. 7 shows in detail one form of the moveable locking beam 20A connection to the track 30, the track 30 correspondingly being fixed to the vessel 90. Slidable elements 57, 57A, 57B are shown connectively engaged between the moveable locking beam 20A and the track 30 in such a way as to prevent vertical movement upwards or downwards and lateral movement of the moveable locking beam 20A other than along the track 30. A moveable locking beam locking device 80A, which may be in the form of a remotely-actuated pin, is shown engaged with the lateral movement limiting means 61A, guide track, which is carried by the track 30. It is recognized that other locking device locations may be used. The riser top means 10 is shown positioned by the cables 60C, 60D of the riser positioning means 60, 60A, in a central location relative to the moveable locking beams 20, 20A, and the track means 30, 30A.

Figure 8:
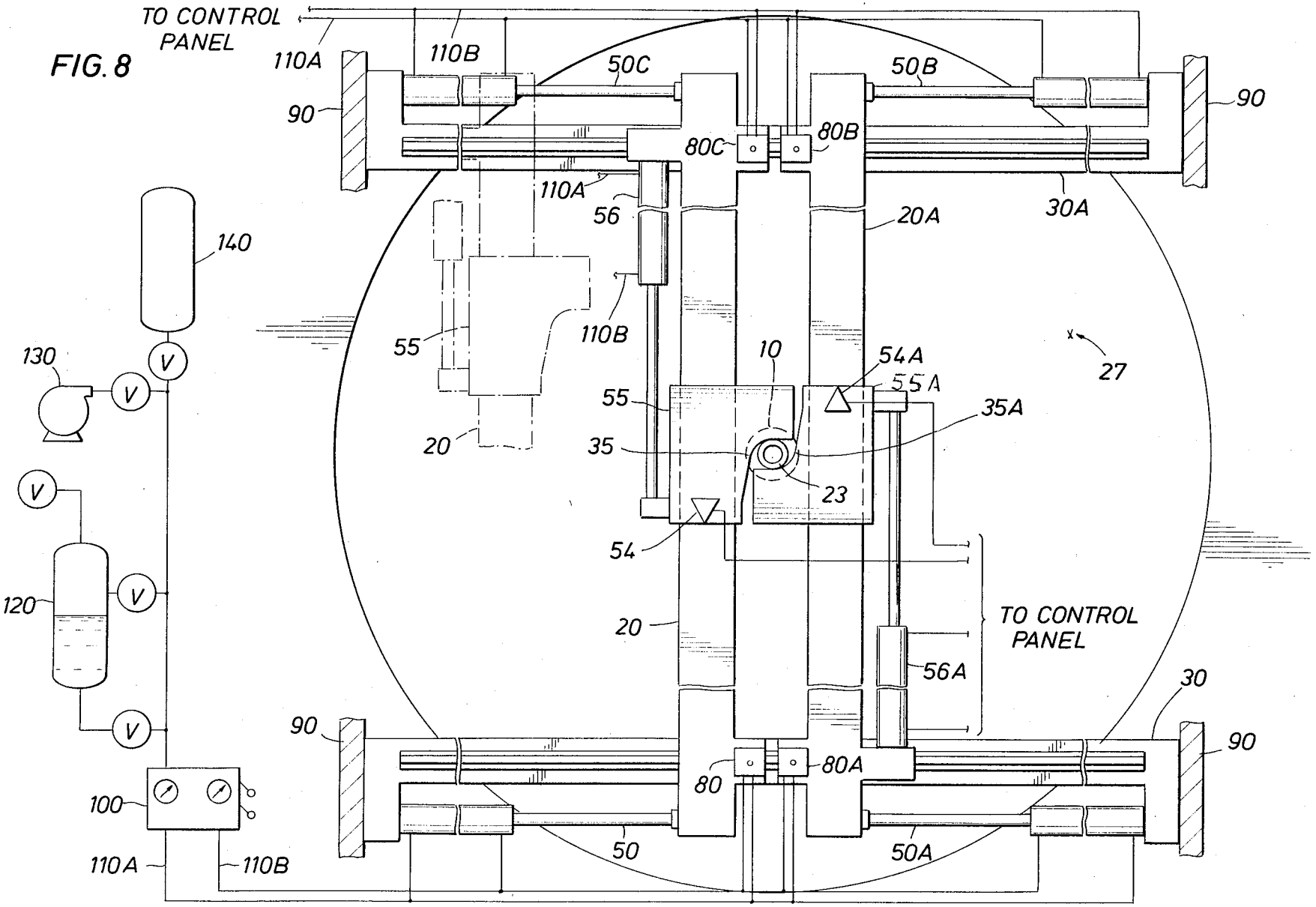
FIG. 8 is a schematic representation of a riser locking operation in which a riser is shown positioned between riser positioning and locking means.

Various other possible riser stop means 10 and landing areas 31, 31A, arrangements can also be used to accomplish the same mechanical results as disclosed in the present invention. As shown in FIG. 8, the riser positioning means 60, 60A may take the form of a pair of positioning slides 55, 55A, engaged with each respective moveable locking beam 20, 20A. As each slide 55, 55A, is moved towards the center of the hull opening, it will contact and eventually center the riser 23.

As shown in FIG. 8, the landing areas 35, 35A may be incorporated in either both of these slides 55, 55A or in the moveable locking beams 20, 20, or in both of these devices. Mounting each slide 55, 55A, in a substantially annular fashion about the outer periphery of the moveable locking beam 20, 20A, as shown in FIG. 8, prevents vertical or horizontal movement of the slides 55, 55A, other than along the moveable locking beams 20, 20A, thereby preventing movement of the riser 23 relative to the moveable locking beams 20, 20A, when the slides 55, 55A, are locked in position.

As shown in FIG. 9, other beam and prime mover configurations may be used to accomplish the same mechanical effect as the apparatus disclosed in the prior drawings.

Figure 9E:
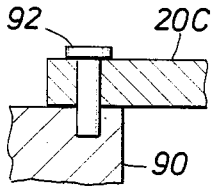
FIGS. 9A–9E are schematic representations of alternate beam and prime mover configuration.
Figure 9A:
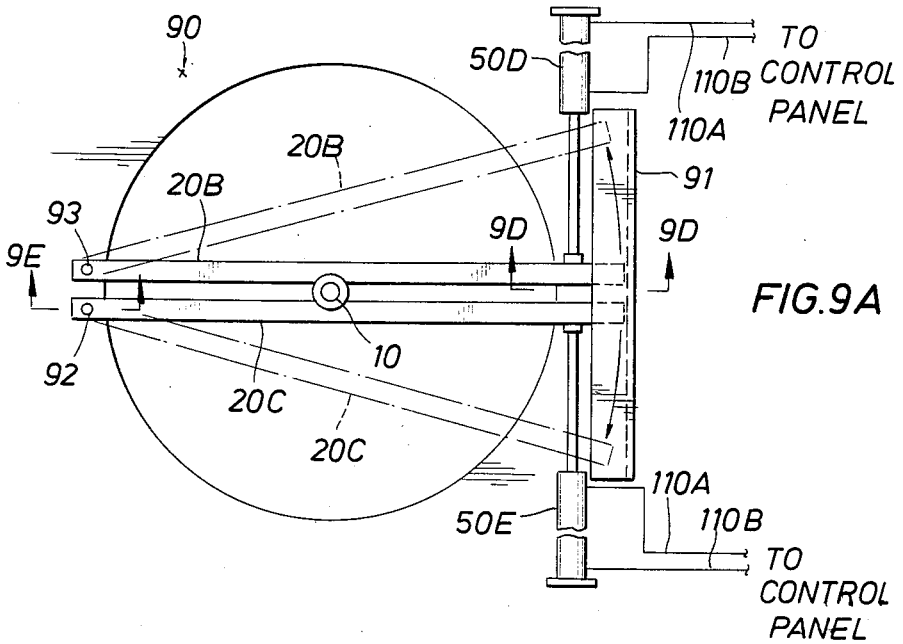
Figure 9D:
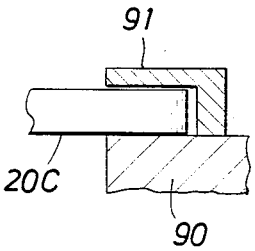
Figure 9B:
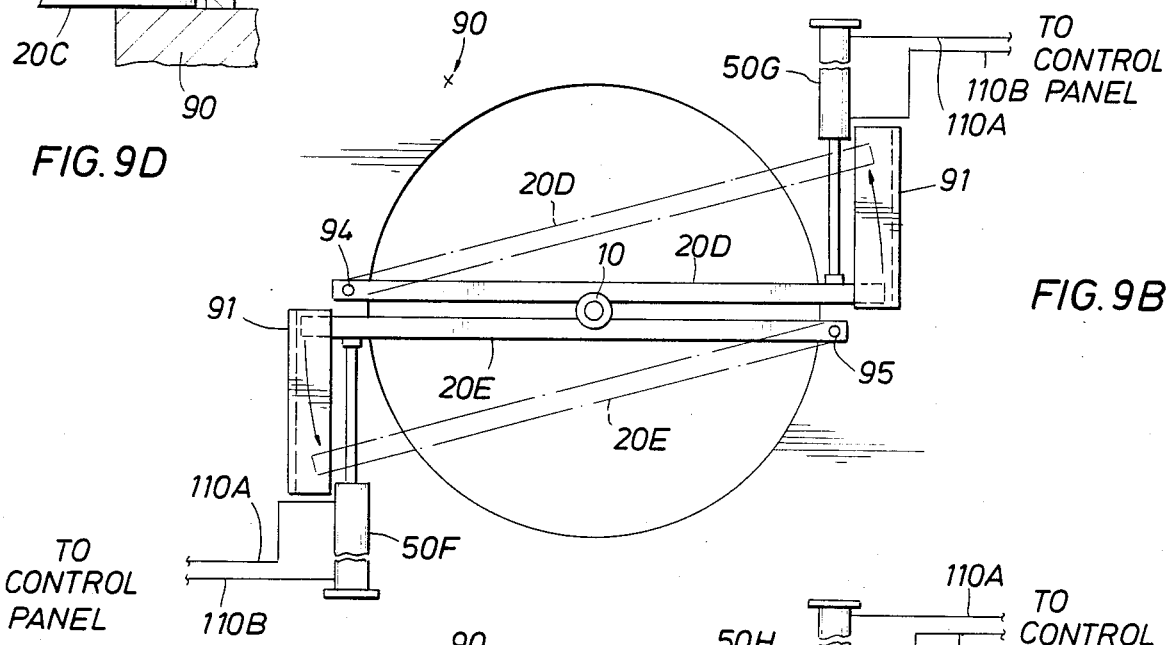
Figure 9C:
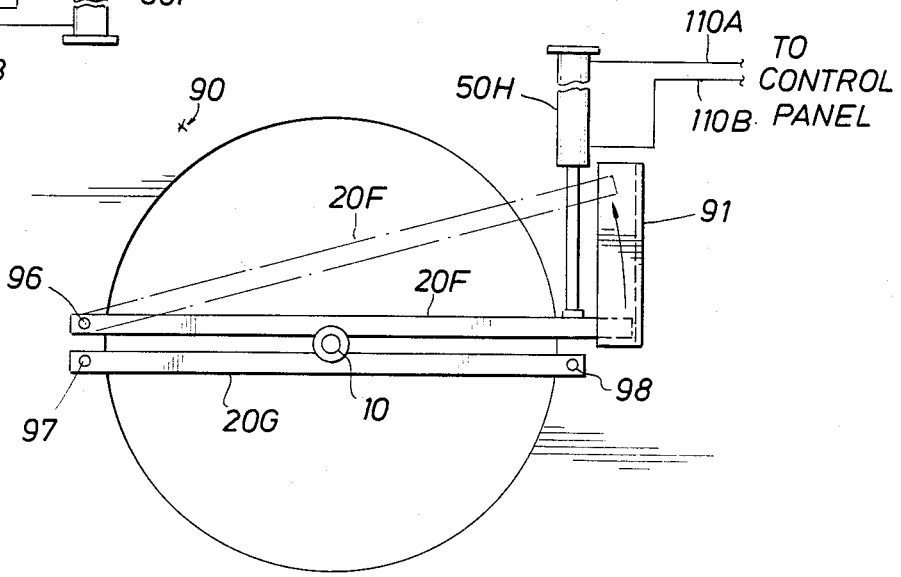

FIG. 9A shows the moveable beams 20B, 20C pinned at one end by pins 92, 93 (FIG. 9E), with prime movers 50D, 50E capable of moving the beams 20B, 20C, toward each other to secure the riser stop means 10 between the beams 20B, 20C. An upward movement limiting device 91 (FIG. 9D) prevents the beams 20B, 20C from upward movement away from the vessel 90. The devices shown in FIG. 9 differ from those previously disclosed in that the moveable beams 20B, 20C, 20D, 20E, 20F, 20G are not slideably engaged with track means, but are pinned at least on one end and, except for 20G slide on the other. The prime mover means 50D, 50E, 50F, 50G, 50H are connected by hydraulic control lines 110A, 110B to a control panel 100. Actuation of these prime mover means 50D, 50E, 50F, 50G, 50H causes the respective moveable beams 20B, 20C, 20E, 20D, 20F to rotate about the respective pins 93, 92, 95, 94, 96. Beams 20G remains stationary, being pinned at both ends by pins 97, 98, and shown in FIG. 9C.

I claim as my invention:

1. For use in a floating vessel having a substantially centrally-positioned vertical hull opening therethrough, said vessel being provided with well drilling equipment, including an elongated vertical riser provided with riser stop means carried outwardly near upper end thereof, flexible coupling means in said riser below the stop means thereof and buoyancy adjusting means on the submerged portion of said riser, said riser extending in tension substantially centrally down thrugh said hull opening to a point adjacent the ocean floor, and motion-compensating and tensioning means carried by said vessel operatively connected to said riser for vertically supporting said riser during normal operations, said improvement comprising auxiliary riser locking means apparatus carried by said vessel substantially within the plan view cross section of the hull opening through the vessel, said locking means apparatus comprising:

at least two track means arranged in spaced relationship on opposite sides of and within said hull opening, and being connected to said vessel, at least a pair of moveable locking beams supported at each end by each of said track means and positioned to span opposite portions of said hull opening, and being moveable toward each other, vertical movement-limiting means engageable with said locking beams and operatively connected to said vessel adjacent said track means to prevent vertical movement of said moveable locking beams away from said track means, at least one landing area carried by each of said moveable locking beams, said landing areas being engageable with at least a portion of said riser stop means, at least a pair of riser-positioning means, each one being operatively connected between said riser and said vessel, and being moveable relative to each other and to the landing areas of said moveable locking beams to selectively position said riser within said hull opening of said vessel, first prime mover means carried by said vessel and operatively connected to said pair of riser positioning means for selectively moving said riser-positioning means, and second prime mover means carried by said vessel and operatively connected to said moveable locking beams for selectively moving said beams.

2. The apparatus of claim 1 wherein the riser positioning means further includes riser-positioning means locking means, for locking said riser positioning means in a substantially fixed position, so as to prevent said riser from moving laterally within said hull opening relative to said vessel.

3. The apparatus of claim 1 wherein said track means are substantially horizontal.

4. The apparatus of claim 1 wherein said track means include a pair of tracks on opposite sides of said hull opening, one member of each pair being positioned vertically above and remaining parallel with the other member of the pair, both pairs of tracks having the same relative elevation with the other pair on the opposite side of the hull opening.

5. The apparatus of claim 4 wherein each end of said moveable locking beam is positioned between an upper track and a lower track, and each end includes track engaging means formed by upward and downward facing surfaces of said moveable locking beam, said track engaging means being engageable with said upper and lower tracks.

6. The apparatus of claim 1 wherein said pair of moveable locking beams move equally toward and away from each other.

7. The apparatus of claim 1 wherein said moveable locking beams when in closest proximity to one another, are in closest proximity to said riser stop means location.

8. The apparatus of claim 1 wherein said moveable locking beams include lateral movement-limiting means carried between said moveable locking beams and said track means, said lateral movement-limiting means formed by co-operating elements, one of said elements being arranged parallel to the longitudinal axis of said track means, another of said elements movably engaged with said longitudinally arranged element, both elements preventing movement of said beams in a direction perpendicular to the longitudinal axis of said tracks.

9. The apparatus of claim 1 wherein the vertical movement limiting means includes:

a downwardly facing surface formed on said track means and being vertically displaced above a cooperating upwardly facing surface of said moveable locking beams, said downwardly facing surface in substantially close proximity to said upwardly facing surface so as to prevent substantial vertical upward movement of said beam relative to said track means.

10. The apparatus of claim 1 wherein the vertical movement limiting means includes:

an upwardly facing surface formed on said track means and being vertically displaced below a correspondingly downwardly facing surface of said moveable locking beams, said upward facing surface being in substantially close proximity to said downward facing surface, so as to prevent substantial vertical downward displacement of moveable locking beam relative to said track means.

11. The apparatus of claim 9 or claim 10 wherein said downward facing surface slideably engages aid upward facing surface.

12. The apparatus of claim 1 wherein said landing areas are located in a face-to-face manner on adjacent sides of said moveable locking beams.

13. The apparatus of claim 1 wherein said riser positioning means include cable and winch means operatively connectable between said riser and said vessel.

14. The apparatus of claim 13 wherein said cable and winch means includes cable connectable to said riser stop means.

15. The apparatus of claim 1 wherein said moveable locking beams includes locking means engageable with said track means for fixedly securing said moveable locking beams to said track means.

16. The apparatus of claim 15 wherein said moveable locking means includes prime mover means for selectively moving said locking means in vertical and horizontal planes for engaging said locking means between said track means and said moveable locking beams, to lock said track means to said moveable locking beams.

17. A method of fixedly securing the elements forming the upper end of a riser to a floating vessel having a substantially centrally positioned vertical hull opening therethrough, said vessel provided with well drilling equipment, including a derrick with associated drill string lift equipment, an elongated vertical riser provided with riser stop means carried outwardly near said riser upper end thereof, a wellhead connector carried at the lower end of said riser and secured to a wellhead assembly, flexible coupling means in said riser below the stop means thereof, and adjustable buoyancy means formed with the submerged portion of said riser, said riser extending in tension during normal operations substantially centrally down through said hull opening to a point adjacent a wellhead assembly located adjacent the ocean floor, said vessel carrying motion-compensating and tensioning means operatively connected to said riser upper elements for vertically supporting said riser during normal operations, and provided with riser locking means apparatus including a pair of locking beams on tracks connected to said vessel;

said method comprising:

remotely disconnecting the wellhead connector at the lower end of said riser from said wellhead assembly;

actuating said riser positioning means, said floating vessel riser motion compensating and tensioning means, and said drill string lift equipment, thereby;

positioning riser stop means adjacent riser locking means apparatus, moving said moveable locking beams along said track means toward each other, and engaging said moveable locking beams with said riser stop means to prevent movement of riser upper elements relative to said floating vessel.

18. The method of claim 17, including the steps of adjusting the buoyancy of said riser by adding and removing adjustable buoyancy means from said riser.

19. The method of claim 17, including the steps of:

transporting said floating vessel with said securedly fixed riser to another location, moving said moveable locking beams along said track means away from each other to disengage said locking beams from said riser stop means, adjusting height of riser for connection to a second wellhead assembly, lowering said riser onto said wellhead assembly, and connecting riser wellhead connector to said wellhead assembly.

20. The method of claim 17, including the step of suspending said riser beneath said floating vessel.

21. The method of claim 20, including the step of suspending said riser beaneath said floating vessel during repair and maintenance operations on said vessel's motion compensating and tensioning equipment which normally supports and tensions said riser.

22. Riser locking means apparatus for fixedly locking the upper end of a riser to a floating vessel, said apparatus carried by said vessel substantially within the plan view cross section of a vertical hull opening through said vessel for lateral movement therein, so as to prevent movement of said upper end of said riser relative to said floating vessel within said vertical hull opening therein, said riser locking means apparatus comprising:

at least two track means arranged in spaced relationship on opposite sides of and within said hull opening, and being connected to said vessel;

at least a pair of moveable locking beams supported at each end by each of said track means, and positioned to span opposite portions of said hull opening, and being moveable toward each other, vertical movement-limiting means engageable with said locking beams and operatively connected to said vessel adjacent said track means to prevent vertical movement of said moveable locking beams away from said track means, at least one landing area carried by each of said moveable locking beams, said landing areas being engageable with at least a portion of said riser stop means, at least a pair of riser-positioning means, each one being operatively connected between said riser and said vessel, and being moveable relative to each other and to the landing areas of said moveable locking beams to selectively position said riser within said hull opening of said vessel, first prime mover means carried by said vessel and operatively connected to said pair of riser positioning means for selectively moving said riser positioning means, and second prime mover means carried by said vessel and operatively connected to said moveable locking beams for selectively moving said beams.

* * * * *